United States Patent [19]

Wagner et al.

[11] 4,325,058

[45] Apr. 13, 1982

[54] PRE-INTRUSION DETECTION AND ALARM SYSTEM

[75] Inventors: William E. Wagner, Holland; Ivan Zachev, Muskegon, both of Mich.

[73] Assignee: Gentex Corporation, Zeeland, Mich.

[21] Appl. No.: 158,619

[22] Filed: Jun. 11, 1980

[51] Int. Cl.[3] ..... G08B 13/26

[52] U.S. Cl. ..... 340/562; 340/528; 340/546

[58] Field of Search ..... 340/562, 546, 528

[56] References Cited

U.S. PATENT DOCUMENTS

| | | | |
|---|---|---|---|
| 4,011,554 | 3/1977 | Butler | 340/562 |
| 4,091,371 | 5/1978 | Mason, Jr. et al. | 340/546 |
| 4,151,520 | 4/1979 | Full | 340/528 |
| 4,168,495 | 9/1979 | Sweeney | 340/546 |
| 4,176,348 | 11/1979 | Tobin et al. | 340/562 |
| 4,227,188 | 10/1980 | Petersen | 340/528 |

*Primary Examiner*—Glen R. Swann, III
*Attorney, Agent, or Firm*—Malcolm R. McKinnon

[57] ABSTRACT

A self-contained pre-intrusion detection and alarm system for doors and other closures, the system including an rf oscillator circuit incorporating a tank circuit which includes an antenna. The system also includes a detection and processing circuit effective to detect and amplify a change in the voltage in the rf oscillator circuit caused by a change in the antenna to ground capacitance; an audio oscillator circuit; time delay circuitry connected between the detecting and processing circuit and the audio oscillator circuit and controlling the energization of the audio oscillator circuit; and an alarm electrically connected to and controlled by the audio oscillator circuit for alerting occupants of potential danger of intrusion and also deterring potential intruders from continuing their activities toward intrusion.

9 Claims, 6 Drawing Figures

PRE-INTRUSION DETECTION AND ALARM SYSTEM

BRIEF SUMMARY OF THE INVENTION

This invention relates to pre-intrusion detectors and alarms and, more particularly, to an improved, self-contained pre-intrusion detection and alarm system incorporating improved means for detecting potential intruders and activating an alarm to warn occupants of potential danger of intrusion and at the same time frighten the potential intruders and deter them from continuing their activities toward intrusion.

Heretofore, pre-intrusion detection and alarm systems have been utilized for the purpose of detecting potential intruders and activating an alarm. However, prior pre-intrusion detection and alarm systems of the indicated character typically have deficiencies that preclude practical application of the devices. For example, many prior devices have high electrical power consumption requirements, and most prior devices will only function on wood doors. Other prior devices of the indicated character do not incorporate an exit delay feature or an entry delay feature with the result that an authorized user of the premises will set off the alarm if the authorized user attempts to open the door or other closure protected by the device for entry or exit purposes. In addition, many prior battery operated pre-intrusion alarms do not provide means for indicating the condition of the battery. Other prior devices require adjustment each time they are applied, and many do not sound an alarm for a sufficient length of time to alert occupants or frighten would-be intruders. For example, some prior devices only provide a short "beep", and many prior units do not provide a *loud* alarm upon actuation. Moreover, most prior devices cannot operate both as a self-contained unit and as a component of an expanded monitoring system providing a second level deterrent capability such as by switching on lights, television sets, radios or additional alarm mechanisms.

An object of the present invention is to overcome the aforementioned as well as other disadvantages in prior pre-intrusion detection and alarm devices of the indicated character and to provide an improved pre-intrusion detection and alarm system for doors and other closures, the system incorporating improved means for detecting potential intruders and activating a loud, piercing alarm to alert occupants of potential danger and at the same time frighten potential intruders so as to deter the potential intruders from continuing their activities toward intrusion.

Another object of the present invention is to provide an improved pre-intrusion detection and alarm system which will operate for at least one year with approximately eight hours use per day while utilizing a conventional 9 volt alkaline type battery, and which incorporates improved electronic circuitry that automatically adjusts to changes in temperature, humidity and other normal circumstances.

Another object of the present invention is to provide an improved pre-intrusion detection and alarm system that may be applied to both wood and metal doors and function properly in most applications.

Another object of the present invention is to provide an improved pre-intrusion detection and alarm system that provides an exit delay automatically each time the system is switched "on".

Another object of the present invention is to provide an improved pre-intrusion detection and alarm system which may be set to activate an alarm immediately upon detection or which may be switched to provide an entry delay to allow normal authorized entry prior to activation of the alarm.

Another object of the present invention is to provide an improved pre-intrusion detection and alarm system incorporating improved means effective to inform the user of the condition of the system including the condition of a battery supplying power thereto.

Another object of the present invention is to provide an improved pre-intrusion detection and alarm system incorporating improved means for testing the sensitivity and performance characteristics of the system without activating the alarm.

Another object of the present invention is to provide an improved pre-intrusion detection and alarm system incorporating improved means for adjusting the sensitivity of the system to avoid nuisance alarms.

Another object of the present invention is to provide an improved pre-intrusion detection and alarm system which may be utilized as a self-contained, portable unit or which may be used to trip a monitor providing a second level deterrent capability by switching on lights, television sets, radios, or other additional alarm mechanisms.

Another object of the present invention is to provide an improved pre-intrusion detection and alarm system incorporating improved alarm means which is activated for a sufficient duration and with sufficient volume to alert occupants of potential intrusion and at the same time frighten potential intruders.

Another object of the present invention is to provide an improved pre-intrusion detection and alarm system which is automatically reset after a predetermined time to a guard mode to protect against additional intrusion attempts.

Another object of the present invention is to provide an improved unitary pre-intrusion detection and alarm apparatus wherein the total electromagnetic field produced at any point a distance of 157,000/F(kHz) feet (equivalent to $\lambda/2\pi$) from the apparatus does not exceed 15 microvolts per meter.

Still another object of the present invention is to provide an improved pre-intrusion detection and alarm apparatus that is economical to manufacture and assemble, durable, efficient and reliable in operation.

The above as well as other objects and advantages of the present invention will become apparent from the following description, the appended claims and the accompanying drawings.

DETAILED DESCRIPTION

Figure 1:
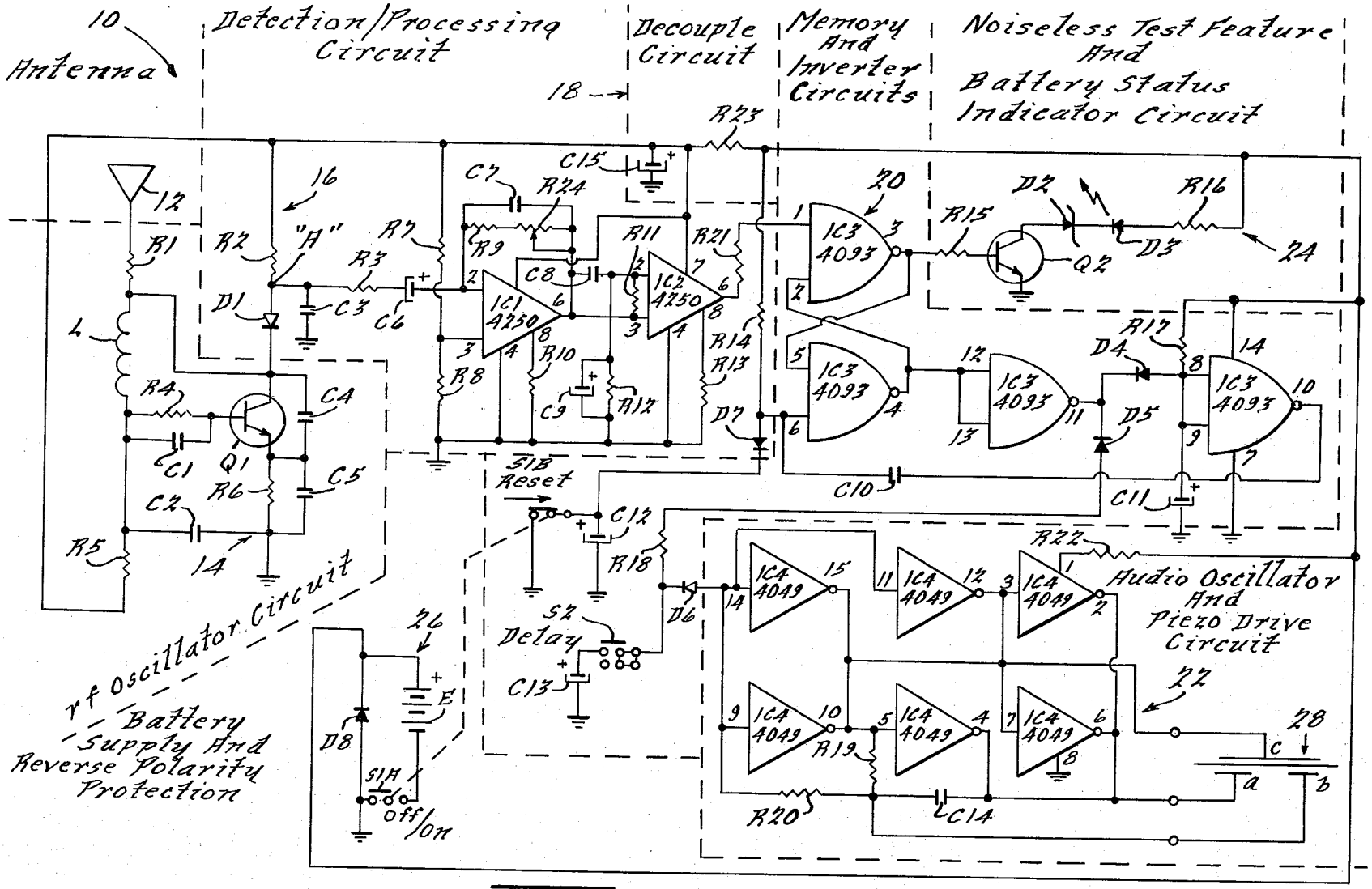
FIG. 1 is a schematic electrical circuit diagram illustrating one embodiment of the present invention.

Referring to the drawings, and more particularly to FIG. 1 thereof, the circuitry for one embodiment of a pre-intrusion detection and alarm system, generally designated 10, embodying the present invention is schematically illustrated therein. As shown in FIG. 1, the system 10 includes an antenna, generally designated 12, an rf oscillator circuit, generally designated 14, a detection/processing circuit, generally designated 16, a decouple circuit, generally designated 18, a memory and inverter circuit, generally designated 20, an audio oscillator and piezo drive circuit, generally designated 22, a noiseless test feature and battery status indicator circuit, generally designated 24, and a battery supply and reverse polarity protection circuit, generally designated 26, the components incorporated in the aforementioned circuits all being electrically connected by suitable conductors as illustrated in the drawings and as will be described hereinafter in greater detail. All of the components of the various circuits are also preferably mounted on or connected to a printed circuit board.

In general, the system 10 illustrated in FIG. 1 of the drawings operates on a capacitive loading principle and the gain of an oscillator is adjusted to a point where oscillation amplitude is affected by the proximity of a human being (less than 1 picofarad loading). In the system 10, the antenna 12 becomes part of a tank circuit while one of the supply lines is grounded. Increased antenna-to-ground capacitance causes damping of the tank circuit. The change in amplitude caused by capacitive loading is amplified by a high gain operational amplifier followed by a Schmitt trigger. The digital signal is used to process various timing cycles, alarm-on and reset functions.

In the embodiment of the invention illustrated, the antenna 12 is comprised of a loop of 18 gauge line cord wire which may, for example, be approximately 12 inches long and which is connected to the printed circuit board (not shown) by means of suitable terminals. The antenna 12 becomes a part of a tank circuit comprised of an inductor L and capacitors C4 and C5 included in the rf oscillator circuit 14 described hereinafter in greater detail. The antenna 12 is connected to the rf oscillator circuit 14 by a resistor R1 which reduces loading effects on the oscillator circuit 14. In addition to the inductor L and the capacitors C4 and C5, the rf oscillator circuit includes a transistor Q1, capacitors C1 and C2, and resistors R4, R5 and R6, such components being connected to a 9 volt battery E as illustrated in FIG. 1. In the rf oscillator circuit 14, base bias is provided by the resistors R4 and R5, and the resistor R6 develops the emitter input signal and also acts as the emitter swamping resistor to provide temperature stability by reducing emitter-base resistance effects. The tuned circuit is comprised of the capacitors C4 and C5 in parallel with the inductor L since the capacitor C2 provides an AC clamp to ground at the operating frequency ($X_{c2}=0.64$ ohms at 2.5 MHz). The capacitors C4 and C5 also provide a voltage divider across the output. It will be understood that either or both of the capacitors C4 and C5 may be changed to control the frequency and amount of feedback voltage. For minimum feedback loss, the ratio of the capacitance reactance of the capacitors C4 and C5 should be approximately equal to the ratio of the output impedance to the input impedance of the transistor Q1. It is preferred that the capacitance values of the capacitors C4 and C5 be made large enough to swamp both the input and the output capacitances of the transistor Q1 to assure oscillations are comparatively independent of changes in the transistor parameters.

Regenerative feedback is obtained from the tank circuit and applied to the emitter of the transistor Q1. The capacitor C5 provides the feedback voltage. Since no phase shift occurs in this circuit, the feedback signal must be connected so that the voltage across the capacitor C5 will be returned to the emitter with no phase shift occurring. The feedback signal is returned between the emitter and ground. As the emitter goes positive, the collector also goes positive, developing the potential polarities across the capacitors C4 and C5. The feedback voltage developed across the capacitor C5 which is fed back between the emitter and ground also goes positive. Therefore, the inphase relationship at the emitter is maintained. The capacitor C1 acts as an AC bypass around the base biasing resistor R4. The rf oscillator circuit 14 produces a sinusoidal wave form with a frequency of 2.5 MHz±0.5 MHz. The rf oscillator circuit 14 operates over a wide voltage range (1.5–15 volt) and at very low current levels (30–195 microamperes). It will be understood that the values of the resistors R5, R6 and R7 and the capacitor C1 should be selected to achieve the lower values of the referenced current operating range. It should also be noted that while the resistors R5 and R6 and the capacitor C1 directly involve the operating characteristics of the rf oscillator circuit 14, the value of the resistor R7 incorporated in the detection/processing circuit 16 must also be correlated therewith so as to calibrate the system sensitivity with respect to the power level in the rf oscillator circuit 14.

The detection/processing circuit 16 is comprised of standard integrated circuits IC1 (No. 4250) and IC2 (No. 4250), capacitors C3, C6, C7, C8 and C9, diodes D1 and D7, and resistors R2, R3, R7, R8, R9, R10, R11, R12, R13, R14, R21 and R24, such components being electrically connected as illustrated in FIG. 1. In the operation of the detection/processing circuit 16, the rf voltage is rectified by the diode D1 and filtered by the capacitor C3, thus providing a constant DC voltage at the point "A" under normal stand-by conditions. This DC voltage is blocked from the sense amplifier IC1 by the capacitor C6. The resistor R3 is an impedance matching resistor to optimize the system. Since the collector of the transistor Q1 is connected through the resistor R1 to the antenna 12, the antenna 12 is part of the oscillator tank circuit previously described. Therefore, any change in the antenna-to-ground capacitance, which occurs when a human being reaches for and/or touches a door knob or latch mechanism from which the antenna 12 is hanging, as will be described hereinafter in greater detail, will cause damping of the tank circuit. Damping of the tank circuit causes a change in the amplitude of the voltage at the point "A". The change in voltage at the point "A" is passed through the capacitor C6 and amplified by the high gain operational amplifier IC1. The gain of the operational amplifier IC1 is set by the series resistance of the resistor R9 plus the resistor R24. The gain of IC1 can be adjusted by the trim potentiometer R24 to match sensitivity requirements caused by different application situations. The reference point for sensitivity is established by the ratio of the resistors R7 and R8, both of which are connected to the positive terminal 3 of IC1. The capacitor C7 is used to provide stability for IC1. The resistors R10 and R13 are quiescent current setting resistors for the programmable low power operational amplifiers IC1 and IC2, respectively. The amplified signal from IC1 is fed into the positive terminal 3 of IC2. Since IC2 is functioning as a comparator, any signal change at the terminals 2 and 3 of IC2 causes a full rail to rail swing ($V_{DD}$ to ground) at the output terminal 6 of IC2. The comparator reference is set by the ratio of the resistors R11 and R12. The capacitor C9 provides a delay for the change in the reference voltage at terminal 2 of IC2 whereas inputs to terminal 3 of IC2 occur immediately. The operation of IC2 in response to signal changes from the output of IC1 provides a monostable action at terminal 6 of IC2. The capacitor C8 is used to provide stability for IC2.

The memory and invertor circuit 20 is comprised of a standard integrated circuit IC3 (No. 4093), capacitors C10, C11, C12 and C13, resistors R.7 and R18, diodes D4, D5 and D6, and also includes conventional double pole, double throw sliding switches having contact S1A, S1B and S2, the switch S2 being utilized for manufacturing economy and convenience. Such components are electrically connected as illustrated in FIG. 1.

In the operation of the memory and invertor circuit 20, the rail to rail swing at the terminal 6 of IC2 is used to set an RS flip-flop which is made from two cross coupled gates of IC3. The two gates used are defined by the terminals 1, 2 and 3, and the terminals 4, 5 and 6. The flip-flop can only be latched after the capacitor C12 has charged through the resistor R14 to the threshold voltage of the input of IC3 at the terminal 6. The resistor R14-capacitor C12 time constant and the IC3 threshold switch point defines the exit delay time. After the exit time has expired (the capacitor C12 has charged over the IC3 threshold voltage), the invertor gate of IC3 at the terminal 11 can become positive in response to a signal from the detection/processing circuit 16 allowing the capacitor C11 to charge through the resistor R17. The resistor R17-capacitor C11 time constant and the IC3 threshold switch point defines the reset or alarm-on cycle. The moment the charge on the capacitor C11 reaches the threshold voltage of the IC3 terminal 8, 9, the gate of IC3 terminal 10 will go negative. This change in voltage produces a negative pulse at the IC3 terminal 6 through the capacitor C10 to reset the flip-flop. At the same time, the terminal 11 of IC3 starts to go from low to high to unclamp the audio oscillator input terminal 14 of an integrated circuit IC4 (No. 4049) incorporated in the audio oscillator and piezo drive circuit 22 (which will be described hereinafter in greater detail) to provide piezo alarm drive. If the switch S2 is in the "instant" position, the piezo alarm horn will sound immediately and stay on until the flip-flop is automatically reset by virtue of the capacitor C11 charging to the threshold level of the IC3 terminals 8, 9. However, if the switch S2 is in the "delay" position, the capacitor C13 must be charged through the resistor R20 until the voltage on IC4 terminal 14 reaches the threshold point. The resistor R20-capacitor C13 time constant and the IC4 threshold switch point defines the entry-delay cycle. After the threshold point is reached, the alarm will sound until it is automatically reset as explained herein above.

In addition to the integrated circuit IC4 (No. 4049) previously mentioned, the audio oscillator and piezo drive circuit 22 includes a capacitor C14, resistors R19, R20 and R22, and a conventional audio transducer piezo horn 28 having anode a, cathode c and feedback b terminals, such components being electrically connected as illustrated in FIG. 1. The audio oscillator and piezo driver is made by using a hex buffer inverter to produce a minimum output of 85 dB at 10 feet with a narrow frequency spectrum of 3,000 Hz±500 Hz. The precise output characteristics can than be used to trigger selective trip monitors which are commercially available and which are tripped only in a narrow frequency spectrum. The resistor R22 is used in a current limiting mode to prevent IC4 from going into a latch-up condition which could result in IC4 overheating with possible consequent damage.

The noiseless test feature and battery status indicator circuit 24 is comprised of a transistor Q2, a zener diode D2, a light emitting diode D3, and resistors R15 and R16. In the operation of the circuit 24, the light emitting diode D3 provides a visual indication of the performance status of the system. When the system is first switched on, the light emitting diode D3 will flash momentarily if the battery voltage is above the minimum level and the system is functioning properly. Such action occurs because the capacitor C9 is in a changing condition which causes the output of IC2 to shift from high to low in a monostable fashion. The input change at terminal 1 of IC3 causes the voltage at terminal 3 of IC3 to go from low to high thus switching on the transistor Q2 which allows the light emitting diode D3 to function, provided the supply voltage exceeds the combined voltage drops represented by the resistor R16, the light emitting diode D3, the zener diode D2 and the transistor Q2 (all in series). The zener diode D2 is selected to allow switching of the light emitting diode D3 when the battery voltage is above a specified level. Since the system will perform down to very low voltage levels, the voltage level selected for cutoff is normally set at 5–6.2 volts to provide a low battery indication (lack of light emitting diode D3 lighting) while the output of the piezo horn 28 is still at the 80–85 dB range. Since the light emitting diode D3 lights whenever the output of the IC3 terminal 3 switches from low to high (assuming proper battery voltage) the light emitting diode D3 can be used as a noiseless test feature for determining sensitivity while the unit is in exit delay or entry delay. Thus, when a human being reaches for and/or touches the antenna 12 or a door knob or latch mechanism from which the antenna 12 is suspended, the light emitting diode D3 will light if the system is functioning properly.

The battery supply and reverse polarity protection circuit 26 includes the battery E and a diode D8 to protect the system from reverse voltage which could be caused by the battery leads being reversed.

The decouple circuit 18 includes a resistor 23 and a capacitor C15 which function to decouple the sensitive portions of the circuit from the logic and alarm portions. This provides an additional margin of stability because it reduces the effects of battery voltage changes and possible noise feedback from the audio oscillator and piezo drive circuit 22.

Figure 3:
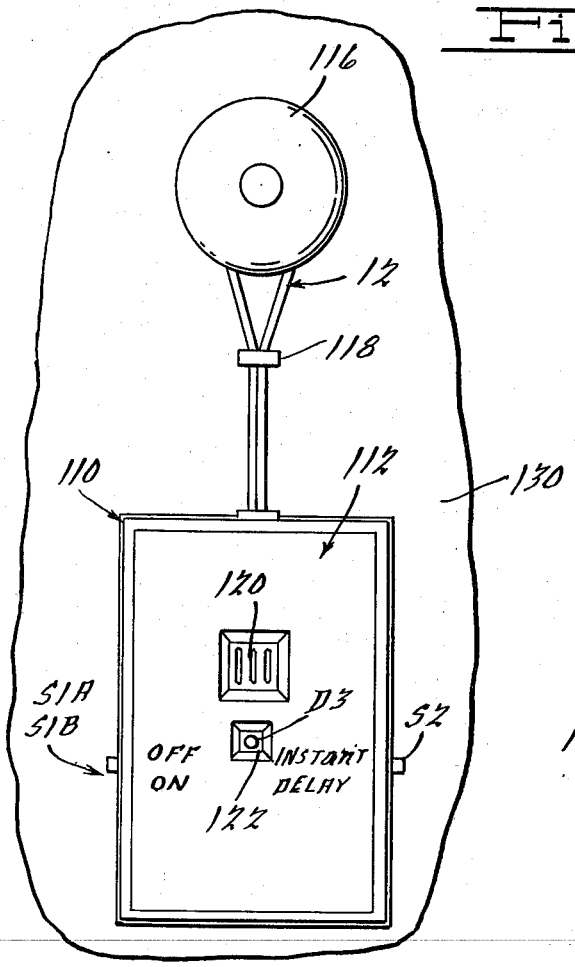
FIG. 3 is a front elevational view of a pre-intrusion detection and alarm unit embodying the present invention, showing the same installed on a metallic door knob.
Figure 4:
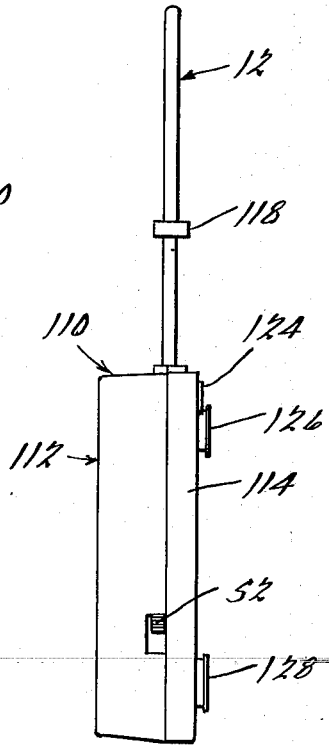
FIG. 4 is an elevational view of the right side of the unit illustrated in FIG. 3.
Figure 5:
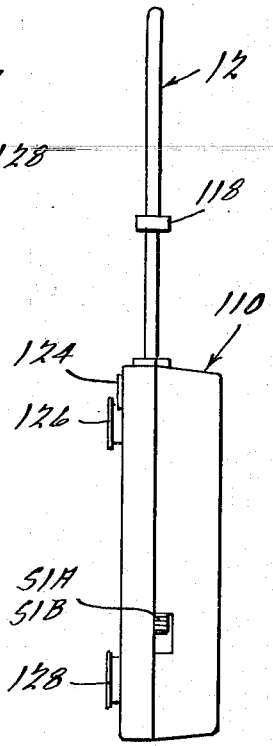
FIG. 5 is an elevational view of the left side of the unit illustrated in FIG. 3.
Figure 6:
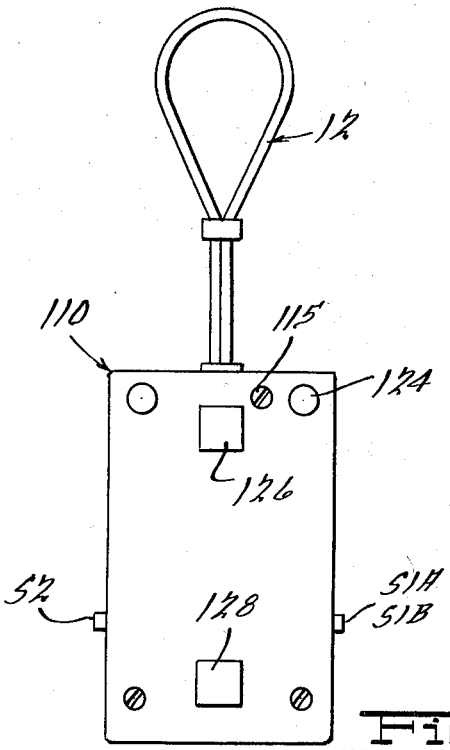
FIG. 6 is a rear elevational view of the unit illustrated in FIG. 3.

The pre-intrusion detection and alarm system 10 includes a housing unit, generally designated 110, which is illustrated in FIGS. 3, 4, 5 and 6 and which is utilized to cover and protect various components of the system. The housing unit 110 is comprised of a front housing 112 and a rear cover 114 which may be joined together in any conventional manner, as for example, by screws 115. The unit 110 is adapted to be suspended from a metallic door knob 116 through the agency of the loop antenna 12 as illustrated in FIG. 3, a ring 118 being provided which is circumposed on the antenna 12 and which may be moved upwardly on the antenna, as viewed in FIG. 3, to hold the unit in place. Openings, such as 120, are provided in the front wall of the front housing 112 whereby the loud piercing sound emitted by the piezo horn 28, which is disposed immediately behind the openings 120, emanates from the housing. An opening 122 is also provided in the front wall of the front housing 112 to permit observation of the light emitting diode D3 a portion of which projects through the opening 122.

In the embodiment of the invention illustrated, the rear wall of the rear cover 114 is also provided with resilient pads, such as 124, and adhesive patches, such as 126 and 128, whereby the unit 110 may be held tightly against the adjacent surface 130 of a door.

As shown in FIG. 3, the manual actuator of the off-/on slide switch S1A and the reset switch S1B projects outwardly from the left side of the front housing 112, as viewed in FIG. 3, while the manual actuator of the delay slide switch S2 projects outwardly from the right side of the front housing 112, as viewed in FIG. 3.

In the operation of the system 10, the unit 110 may be placed on the inside of a door by hanging the loop antenna 12 over the shaft of a metallic door knob and then sliding the ring 118 on the loop antenna upwardly to hold the unit in place. The adhesive patches 126 and 128 may also be adhered to the surface 130 of the door to prevent swinging movement of the unit 110. As previously mentioned, the system 10 is designed to provide "instant" alarm or "delay" alarm to allow entry time before the alarm is actuated. The instant/delay slide switch S2 is set to the desired position, and the "off/on" and "reset" switch contacts S1A and S1B are closed. The light emitting diode D3 will then flash indicating that the system is operating properly and that the battery has sufficient power. After a predetermined time, as for example 18 seconds (the exit time), the system 10 will automatically be set into a guard mode. If a human being attempts entry by touching the door knob 116 on the outside of the door, the system 10 will sense this action and trigger the piezo horn 28. If the switch S2 is set for "instant", the alarm will sound immediately. However, if the switch S2 is set for "delay", the alarm will be delayed for a predetermined period of time, as for example 17 seconds, and then the piezo horn 28 will emit a loud piercing sound. Such delay will permit an authorized person to enter through the door and turn off the unit before the alarm is sounded. The system will automatically reset in approximately 75 seconds in the embodiment of the invention illustrated. Manual reset can be accomplished by switching the "off/on" actuator from "on" to "off" and back to "on". It will be understood that each time the system is switched from "off" to "on", the exit delay is activated. During the exit delay cycle, the sensitivity and performance characteristics of the system 10 can be tested without tripping the alarm. This is done by simply reaching for and/or touching the door knob. The system 10 will then energize the light emitting diode D3 each time the system senses a person's hand. After the exit delay period has expired, as for example approximately 18 seconds after the system has been switched on, if the system is in the "instant" trip mode, the alarm will sound immediately if the door knob is touched and the light emitting diode D3 will turn on and stay on until the system is reset. If the system is in the "delay" mode, the light emitting diode D3 will turn on immediately and stay on, and the piezo horn 28 will sound after the entry delay period, as for example approximately 17 seconds. The system will automatically reset after a predetermined period of time, as for example 75 seconds.

It should be understood that the system 10 may not operate properly on all-aluminum type glass patio doors or on some plastic door knobs. If an all-aluminum type glass patio door is to be protected, the unit 110 should be rested on the floor with the antenna 12 touching the track. Movement of the door will then cause the system 10 to operate properly and sound the piezo horn 28. Although the system 10 has been designed primarily for securing doors against intruders, the system 10 can be used to detect movement of other objects and provide additional security. Other suggested uses for movement detection include placing the unit 110 on the floor behind doors that for some reason will not permit normal use, as for example doors equipped with plastic door knobs. If a person reaches for or touches the antenna 12 when the unit is so disposed, the alarm will then sound in the manner previously described. The unit 110 may also be leaned against a closed window, against the door of a cabinet, such as a gun cabinet, a liquor cabinet or a medicine cabinet, or placed in desk drawers or file cabinets, and the system 10 will sound the alarm in the manner previously described if a person reaches for and/or touches the antenna 12. Other uses will occur to persons skilled in the art or persons utilizing the system 10.

Figure 2:
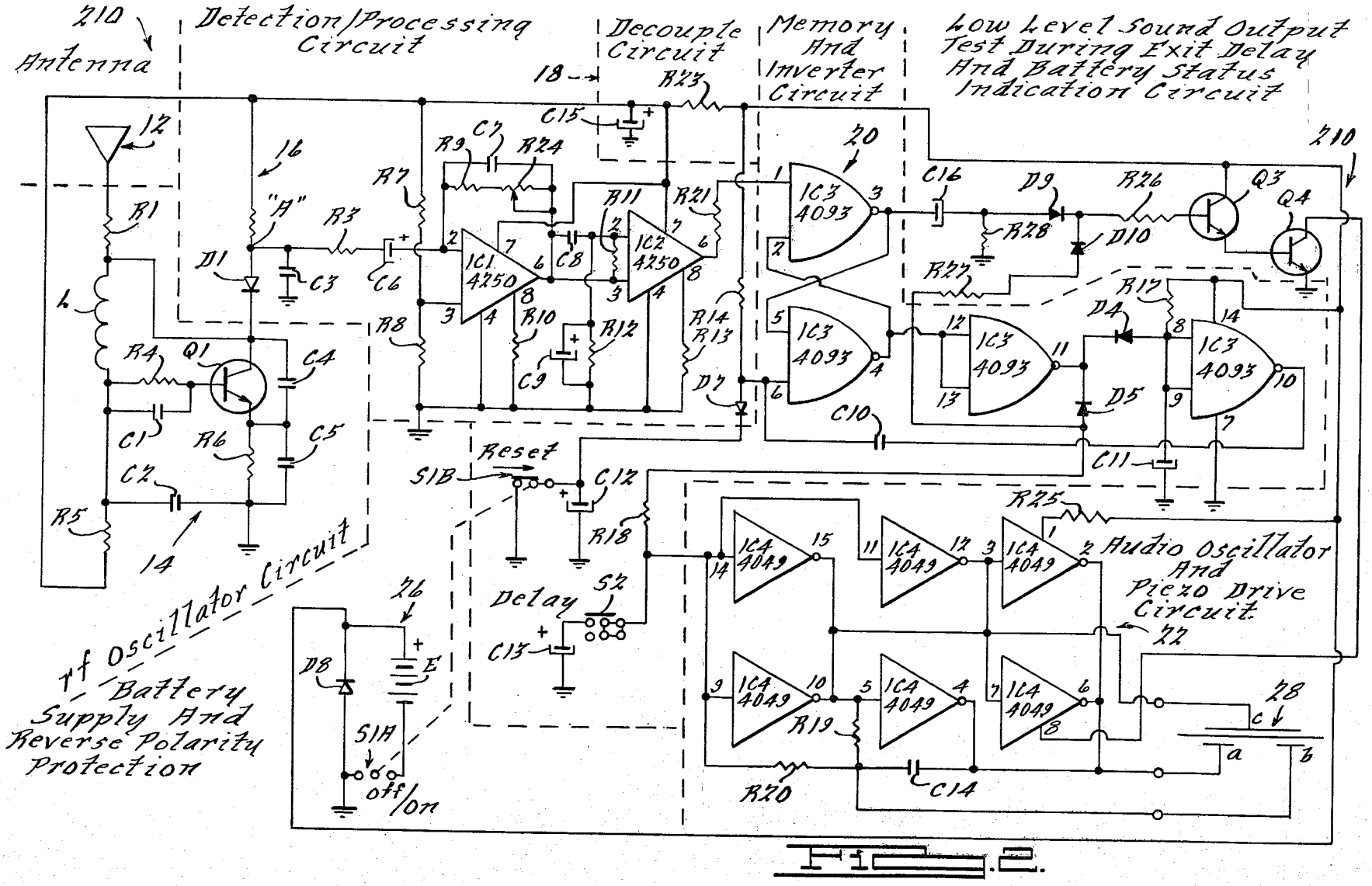
FIG. 2 is a schematic electrical circuit diagram illustrating another embodiment of the present invention.

Referring to FIG. 2 of the drawings, the circuitry for another embodiment of a pre-intrusion detection and alarm system, generally designated 210, is schematically illustrated therein. This embodiment of the invention provides a low level sound output for testing and battery status indication during the exit delay period, rather than the noiseless test feature and battery status indicator provided in the embodiment of the invention illustrated in FIG. 1. In the embodiment of the invention illustrated in FIG. 2, the resistors R15, R16 and R22; the diodes D2, D3 and D6; and the transistor Q2 are deleted from the system and resistors R25, R26, R27 and R28, a capacitor C16, diodes D9 and D10, and transistors Q3 and Q4 are added to the circuitry. The two diodes D9 and D10 provide an "or" circuit to activate the piezo horn 28 in response to either a momentary change in the IC3, pin 3 output (which can occur during exit delay or in the standby mode) or a momentary change in the IC3, pin 3 output and a latched-in change on IC3 pin 4 which occurs in the standby mode. If the detection response occurs during the exit delay period, the piezo horn 28 output is a short "beep" which occurs each time there is a detection action. The short "beep" advises the user that the unit is functioning properly and since the piezo horn 28 output falls off as the battery voltage decays, it is an indicator for low voltage conditions. When the "beep" sound becomes very low, it is time to change the battery. Thus, the circuitry illustrated in FIG. 2 basically converts the visual indication provided by the light emitting diode D3 to a sound output. The remaining portions of the circuit illustrated in FIG. 2 operate in the manner previously described in connection with the operation of the circuitry illustrated in FIG. 1.

It will be understood that the system 210 may also be used in conjunction with the housing 110, and that it is not necessary to provide the opening 122 in the front wall thereof when the system 210 is utilized.

Both of the systems 10 and 210 are designed so that the total electromagnetic field produced at any point a distance of 157,000/F(kHz) feet (equivalent to $\lambda/2\pi$) from the apparatus does not exceed 15 microvolts per meter.

Typical values for the components of the systems 10 and 210 described hereinabove are as follows:

| | |
|---|---|
| C1 | Capacitor, Ceramic, 100 pF |
| C2 | Capacitor, Ceramic, .1 mfd |
| C3 | Capacitor, Ceramic, .1 mfd |
| C4 | Capacitor, Ceramic, 33 pF |
| C5 | Capacitor, Ceramic, 250 pF |
| C6 | Capacitor, Alum. Elec., 10 mfd |
| C7 | Capacitor, Ceramic, .01 mfd |
| C8 | Capacitor, Ceramic, 500 pF |
| C9 | Capacitor, Alum. Elec., 10 mfd |
| C10 | Capacitor, Ceramic, .022 mfd |
| C11 | Capacitor, Alum. Elec., 3.3 mfd |
| C12 | Capacitor, Alum. Elec., 3.3 mfd |
| C13 | Capacitor, Alum. Elec., 22 mfd |
| C14 | Capacitor, Polyester Film, .001 mfd |
| C15 | Capacitor, Alum. Elec., 100 mfd |
| C16 | Capacitor, Alum. Elec., 3.3 mfd |
| D1 | Diode, 1N4148 |
| D2 | Diode, Zener, 1N5228 |
| D3 | L.E.D., Gallium Phosphide |
| D4 | Diode, 1N4148 |
| D5 | Diode, 1N4148 |
| D6 | Diode, 1N4148 |
| D7 | Diode, 1N4148 |
| D8 | Diode, 1N4004 |
| D9 | Diode, 1N4148 |
| D10 | Diode, 1N4148 |
| IC1 | Integrated Circuit, 4250 |
| IC2 | Integrated Circuit, 4250 |
| IC3 | Integrated Circuit, 4093 |
| IC4 | Integrated Circuit, 4049 |
| L1 | Coil, 100 micro H |
| Q1 | Transistor, 2N3904 |
| Q2 | Transistor, 2N3904 |
| Q3 | Transistor, 2N3904 |
| Q4 | Transistor, 2N3904 |
| R1 | Resistor, ¼ w., 1 K ohm ± 10% |
| R2 | Resistor, ¼ w., 1 MEG ohm ± 10% |
| R3 | Resistor, ¼ w., 15 K ohm ± 5% |
| R4 | Resistor, ¼ w., 330 K ohm ± 5% |
| R5 | Resistor, ¼ w., 33 K ohm ± 5% |
| R6 | Resistor, ¼ w., 15 K ohm ± 5% |
| R7 | Resistor, ¼ w., 180 K ohm ± 5% |
| R8 | Resistor, ¼ w., 68 K ohm ± 5% |
| R9 | Resistor, ¼ w., 680 K ohm ± 5% |
| R10 | Resistor, ¼ w., 22 MEG ohm ± 5% |
| R11 | Resistor, ¼ w., 12 K ohm ± 5% |
| R12 | Resistor, ¼ w., 330 K ohm ± 5% |
| R13 | Resistor, ¼ w., 22 MEG ohm ± 5% |
| R14 | Resistor, ¼ w., 6.2 MEG ohm ± 5% |
| R15 | Resistor, ¼ w., 4.7 K ohm ± 5% |
| R16 | Resistor, ¼ w., 1 K ohm ± 10% |
| R17 | Resistor, ¼ w., 18 MEG ohm ± 10% |
| R18 | Resistor, ¼ w., 1 K ohm ± 10% |
| R19 | Resistor, ¼ w., 160 K ohm ± 5% |
| R20 | Resistor, ¼ w., 1.2 MEG ohm ± 5% |
| R21 | Resistor, ¼ w., 1 K ohm ± 10% |
| R22 | Resistor, ¼ w., 100 ohm ± 10% |
| R23 | Resistor, ¼ w., 4.7 K ohm ± 5% |
| R24 | Potentiometer, 2M |
| R25 | Resistor, ¼ w., 47 ohm |
| R26 | Resistor, ¼ w., 4.7 K ohm |
| R27 | Resistor, ¼ w., 4.7 K ohm |
| R28 | Resistor, ¼ w., 100 K ohm |

It will be understood, however, that these values may be varied depending upon the particular application of the principles of the present invention.

From the foregoing, it will be appreciated that with the above or comparable values for the various components of the systems 10 and 210, the systems will operate for at least one year at eight hours use per day with a conventional 9 volt alkaline type battery; that the systems can be applied to both wood and metal doors and will function properly in most applications; that the systems provide an exit delay automatically each time the systems are switched "on"; that the systems can be set to sound an alarm immediately upon detection or the systems can be switched to provide an entry delay to allow normal entry prior to sounding of the alarm; that each of the systems are provided with means for indicating that the systems are functioning properly when the systems are first switched "on" and with means for indicating when the battery voltage has dropped to an unsatisfactory level; and that in each of the systems, during the exit delay period, the systems can be tested for sensitivity and performance characteristics without tripping the loud piercing alarm. It will also be appreciated that each of the systems 10 and 210 provides a sensitivity adjustment to permit the user the flexibility of increasing or decreasing sensitivity for unusual applications, as for example when the systems are applied to metal doors or under high vibration conditions. It will also be appreciated that each of the systems 10 and 210 includes a piezo electric transducer type alarm the output of which is 3000 Hz±500 Hz and that this unique frequency output can be used to trigger a selective, commercially available, trip monitor to back up the door alarm with a second level deterrant capability by switching on lights, television sets, radios or other additional alarm mechanisms. It will also be appreciated that the systems 10 and 210 incorporate improved alarm means which is activated for a sufficient duration and with sufficient volume to alert occupants of potential intrusion and at the same time frighten potential intruders, the alarm in both systems providing an 85 dB output measured at 10 feet.

From the foregoing, it will also be appreciated that the systems 10 and 210 provide high performance characteristics while operating at very low voltage and power levels. For example the standby current required by the systems 10 and 210 is less than 195 microamperes. This has been accomplished by optimizing the design of the front-end rf oscillator, use of programmable low power operational amplifiers and conventional integrated circuits for logic, timing and piezo horn driver requirements.

From the foregoing description, it will be appreciated that three timing cycles are accomplished using a single integrated circuit (type 4093) which provides for exit delay, optional entry delay, and automatic reset. In addition, the use of a gallium phosphide (GaP) light emitting diode in the system 10 provides high luminous output at low drive current to facilitate the noiseless test feature and battery voltage status indication. It will also be appreciated that the systems 10 and 210 achieve maximum cost effectiveness through the use of standard high volume integrated circuits and general purpose discrete components. The rf oscillator circuit incorporated in both systems achieves stable operation over a wide range of voltages (1.5–15 volts) and at extremely low current values (30–195 microamperes). The two operational amplifiers provide both signal processing and monostable action to trigger the logic/timing functions, and the single 4093 type integrated circuit controls three timing functions using the IC threshold voltage characteristics with various RC time constants to control the exit delay, the entry delay and the automatic reset. Moreover, the rf oscillator circuit is AC coupled to the detection, logic and alarm portions of each system to provide stability and temperature compensation. In addition, the use of the integrated circuit No. 4049, with current limit provision to prevent latch-up and overheating, provides high piezo alarm output with low current supply.

While preferred embodiments of the invention have been illustrated and described, it will be understood that various changes and modifications may be made without departing from the spirit of the invention.

What is claimed is:

1. In a detection and alarm system, the combination including an antenna; a DC power source; a first resistor; a tank circuit including said antenna, an inductor, and first and second capacitors; an rf oscillator circuit; said rf oscillator circuit including said tank circuit, a transistor having an emitter, a collector and a base, third and fourth capacitors, and second, third and fourth resistors; said inductor being connected to said antenna through said first resistor; said first capacitor being connected across said emitter and said collector; said second capacitor being connected between said emitter and ground; said first and second capacitors also being connected in parallel with said inductor; said second and third resistors being connected in series between said DC power source and said base; said fourth resistor being connected in parallel with said second capacitor; said third capacitor being connected across said second resistor; said fourth capacitor being connected across the series combination of said third resistor and said DC power source; detection and processing means connected to said collector and effective to detect and amplify a change in the voltage at said collector of said transistor; audio oscillator means; a memory and inverter circuit including time delay means connected between said detection and processing means and said audio oscillator means and controlling the energization of said audio oscillator means; and an audio transducer electrically connected to and controlled by said audio oscillator means.

2. The combination as set forth in claim 1 including a decouple circuit comprising a capacitor and a resistor electrically connected to said rf oscillator circuit, said detection and processing means and said DC power source and effective to reduce noise feedback from said audio oscillator means and said audio transducer.

3. The combination as set forth in claim 1, said audio oscillator means including an integrated circuit, and resistance means connected in series between said integrated circuit and said DC power source.

4. The combination as set forth in claim 1, said audio transducer having an audio output with a frequency of approximately 3,000 hertz.

5. The combination as set forth in claim 1, said audio transducer having an output with a frequency in the range between 2,500 and 3,500 hertz.

6. The combination as set forth in claim 1, and an indicator circuit including a Zener diode and a light emitting diode connected in series between said DC power source and said memory and inverter circuit and effective to indicate the status and quality of said DC power source.

7. In a detection and alarm system, the combination including an antenna; a DC power source; a first resistor; an rf oscillator circuit; said rf oscillator circuit including a transistor having an emitter, a collector and a base, an inductor, first, second, third and fourth capacitors, and second, third and fourth resistors; said inductor being connected to said antenna through said first resistor; said first capacitor being connected across said emitter and said collector; said second capacitor being connected between said emitter and ground; said first and second capacitors also being connected in parallel with said inductor; said second and third resistors being connected in series between said DC power source and said base; said fourth resistor being connected in parallel with said second capacitor; said third capacitor being connected across said second resistor; said fourth capacitor being connected across the series combination of said third resistor and said DC power source whereby the total electromagnetic field produced at any point a distance of 157,000/F(kHz) feet (equivalent to $\lambda/2\pi$) from said antenna does not exceed 15 microvolts per meter; a detection and processing circuit connected to said collector and effective to detect and amplify a change in the voltage at said collector of said transistor caused by a change in the antenna to ground capacitance; an audio oscillator circuit; a memory and inverter circuit including time delay means and connected to said audio oscillator circuit and said detection and processing circuit and controlling the energization of said audio oscillator circuit; an audio transducer connected to and controlled by said audio oscillator circuit; and a decouple circuit including capacitance means and resistance means electrically connected to said rf oscillator circuit, said detection and processing circuit and said DC power source and effective to reduce noise feedback from said audio oscillator circuit and said audio transducer.

8. The combination as set forth in claim 7 including resistance means electrically connected in series between said DC power source and said audio oscillator circuit.

9. The combination as set forth in claim 7, and an indicator circuit including a Zener diode and light emitting diode connected in series between said memory and inverter circuit and said DC power source and effective to indicate the status and quality of said DC power source.

* * * * *